US009434188B2

(12) United States Patent
Ushiama

(10) Patent No.: US 9,434,188 B2
(45) Date of Patent: Sep. 6, 2016

(54) LIQUID DISCHARGING APPARATUS

(71) Applicant: Seiko Epson Corporation, Tokyo (JP)

(72) Inventor: Jun Ushiama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/735,342

(22) Filed: Jun. 10, 2015

(65) Prior Publication Data

US 2015/0367660 A1 Dec. 24, 2015

(30) Foreign Application Priority Data

Jun. 18, 2014 (JP) ..... 2014-125090

(51) Int. Cl.

*B41J 13/00* (2006.01)
*B41J 15/00* (2006.01)
*B41J 15/16* (2006.01)

(52) U.S. Cl.

CPC ..... *B41J 13/0009* (2013.01); *B41J 15/00* (2013.01); *B41J 15/16* (2013.01); *G03G 2215/00556* (2013.01)

(58) Field of Classification Search

CPC ..... B41J 11/42; B41J 29/393; B41J 29/38; B41J 3/60; B41J 11/0095; B41J 15/16; B41J 15/00; B41J 13/0009; G03G 2215/00556

USPC ..... 347/16

See application file for complete search history.

(56) References Cited

U.S. PATENT DOCUMENTS

| | | | | |
|---|---|---|---|---|
| 4,528,576 | A * | 7/1985 | Koumura | B41J 2/2132 347/15 |
| 4,669,900 | A * | 6/1987 | Miyake | B41J 1/24 318/640 |
| 6,334,564 | B1 * | 1/2002 | Kishine et al. | 226/42 |
| 2010/0053251 | A1 * | 3/2010 | Igarashi | B41J 3/543 347/16 |
| 2011/0076082 | A1 * | 3/2011 | Ouchi | 400/583 |

FOREIGN PATENT DOCUMENTS

| | | | |
|---|---|---|---|
| JP | 2009-256095 | A | 11/2009 |
| JP | 2010-052379 | A | 3/2010 |
| JP | 2010-052380 | A | 3/2010 |
| JP | 2010-052931 | A | 3/2010 |
| JP | 2013-220884 | A | 10/2013 |

* cited by examiner

*Primary Examiner* — Manish S Shah
*Assistant Examiner* — Yaovi M Ameh

(57) ABSTRACT

A liquid discharging apparatus includes a feeding unit that feeds a medium, a feeding driving unit that drives the feeding unit, a liquid discharging unit that performs a discharging operation of discharging a liquid to the medium, and a controller that controls the feeding driving unit to start to operate in synchronization with a timing when the liquid discharging unit finally discharges the liquid in the discharging operation.

7 Claims, 5 Drawing Sheets

LIQUID DISCHARGING APPARATUS

BACKGROUND

1. Technical Field

The present invention relates to a liquid discharging apparatus which discharges liquid to a medium.

2. Related Art

In the related art, a printer is known in which a printing head that discharges ink droplets to sheet, a transportation driving roller that transports the sheet, which is installed on a downstream side in a supply direction of the sheet supplied from a roll body around which the sheet is wound, a PF motor that drives the transportation driving roller, and a controller that controls a starting operation of the PF motor are included (JP-A-2009-256095).

The printer alternately performs a sheet transporting operation by the transportation driving roller and an ink droplets discharging operation by the print head, when performing a recording operation once.

However, in such a printer, when a time interval occurs between the ink droplets discharging operation and the sheet transporting operation, there is a problem in that a throughput of the recording operation deteriorates.

SUMMARY

An advantage of some aspects of the invention is to provide a liquid discharging apparatus capable of improving a throughput of the recording operation.

According to an aspect of the invention, there is provided a liquid discharging apparatus including a feeding unit that feeds a medium, a feeding driving unit that drives the feeding unit, a liquid discharging unit that performs a discharging operation of discharging liquid to the medium, and a controller that controls the feeding driving unit to start to operate in synchronization with a timing when the liquid discharging unit finally discharges the liquid in the discharging operation.

In this configuration, in order for the feeding driving unit start to operate in synchronized with the timing when the liquid is finally discharged in the discharging operation, it is possible to start feeding of the medium at the same timing as a timing when the liquid is finally discharged in the discharging operation. Accordingly, an occurrence of a time interval between the discharging operation of the liquid and the feeding operation of the medium can be suppressed. Therefore, a throughput of the recording operation can be improved.

It is preferable that the liquid discharging apparatus further includes a holding unit that holds a roll body around which the medium is wound and a rotation driving unit that rotates the roll body through the holding unit so that the medium is pulled out from the roll body, in which the controller controls the rotation driving unit so that the rotation driving unit starts to operate before starting to operate the feeding driving unit.

When the rotation driving unit starts to operate simultaneously with the feeding driving unit, there is a case in which a movement of the roll body deteriorates with respect to a movement of the feeding unit by inertia of the roll body. In such a case, there is a problem in that a tension is excessively applied to the medium pulled out from the roll body.

In this case, by the rotation driving unit starting to operate before the feeding driving unit, a delay of the movement of the roll body with respect to the movement of the feeding unit is suppressed. Accordingly, the excessive tension being applied to the medium pulled out from the roll body can be suppressed.

It is preferable that the liquid discharging apparatus further includes a moving unit that moves the liquid discharging unit in a scan direction orthogonal to a feeding direction of the medium during the discharging operation, and a detecting unit that detects a position of the liquid discharging unit in the scan direction, in which the controller includes a reach detecting unit which detects that the liquid discharging unit reaches a reference position which is a front position at a predetermined distance from a final discharging position where the liquid discharging unit finally discharges the liquid in the discharging operation, and the controller, on the basis of a reach detection by the reach detecting unit, controls the rotation driving unit start to operate and the feeding driving unit start to operate after a delay time elapses from the reach detection.

In this configuration, the reach detecting unit detects that the liquid discharging unit reaches the reference position, and the feeding driving unit starts to operate after the delay time elapses from the reach detection, the feeding driving unit can be controlled so that the liquid discharging unit starts to operate in synchronization with a timing when the liquid is finally discharged in the discharging operation.

It is preferable that the controller includes a diameter acquiring unit which acquires a diameter of the roll body, and changes the delay time based on the diameter of the roll body acquired by the diameter acquiring unit.

In this configuration, the delay time can be appropriately changed on the basis of the acquired diameter of the roll body.

It is preferable that the controller includes a speed setting unit which sets a feeding speed of the medium, and changes the delay time based on the feeding speed set by the speed setting unit.

In this configuration, the delay time can be appropriately changed on the basis of the set speed.

It is preferable that the controller includes a tension setting unit which sets a tension applied to the medium between the roll body and the feeding unit, and changes the delay time based on the tension set by the tension setting unit.

In this configuration, the delay time can be appropriately changed on the basis of the set tension.

It is preferable that the liquid discharging apparatus further includes the holding unit that holds a roll body around which the medium is wound and a rotation driving unit that rotates the roll body through the holding unit so that the medium is pulled out from the roll body, in which the controller controls the rotation driving unit so that the rotation driving unit starts to operate in synchronization with an operation starting of the feeding driving unit.

In this configuration, the feeding driving unit and the rotation driving unit start to operate in synchronization with a timing when the liquid is finally discharged in the discharging operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described with reference to attached drawings.

Figure 1:
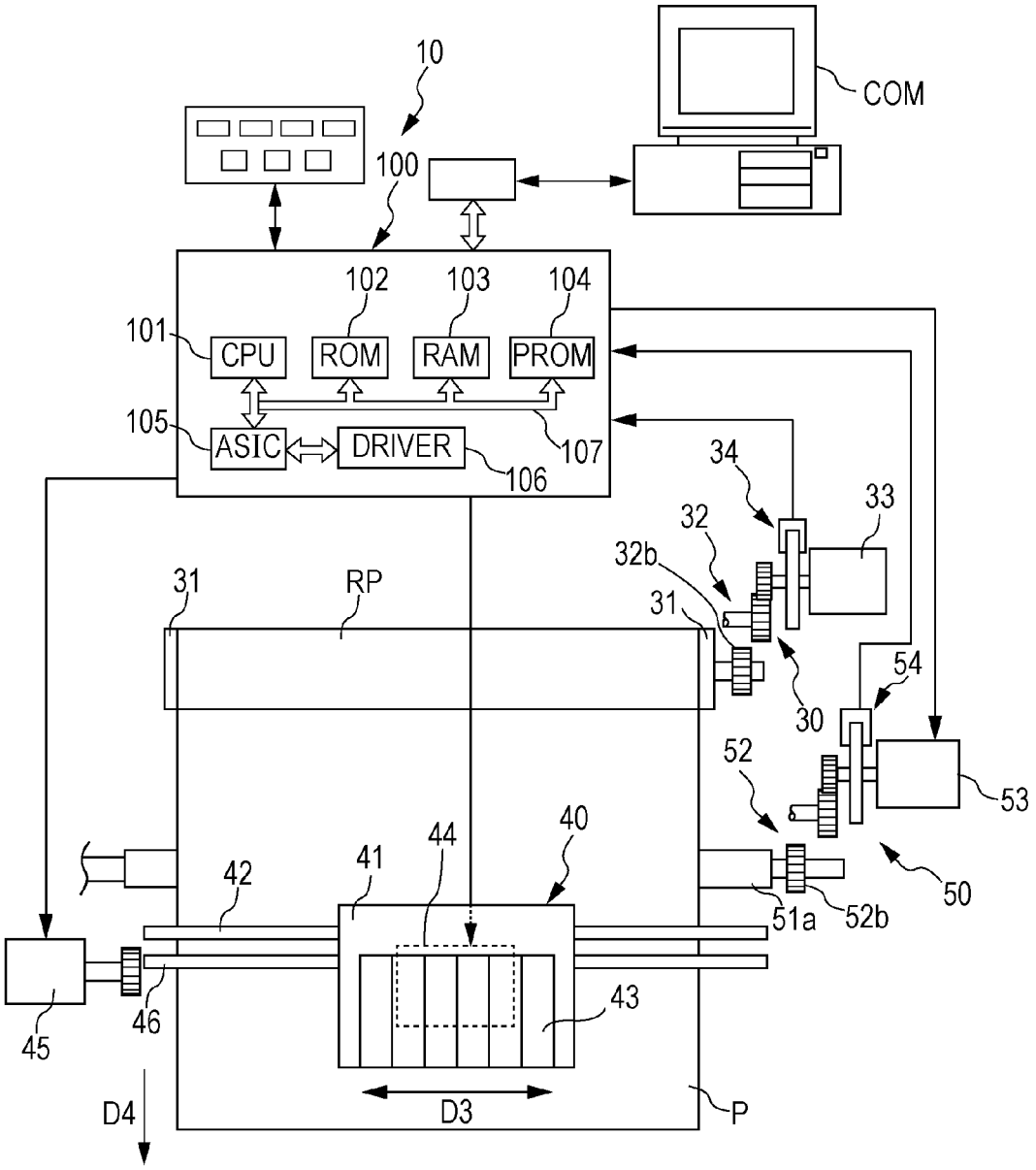
FIG. 1 is a view illustrating a schematic configuration of a recording apparatus according to an embodiment of the invention.
Figure 2:
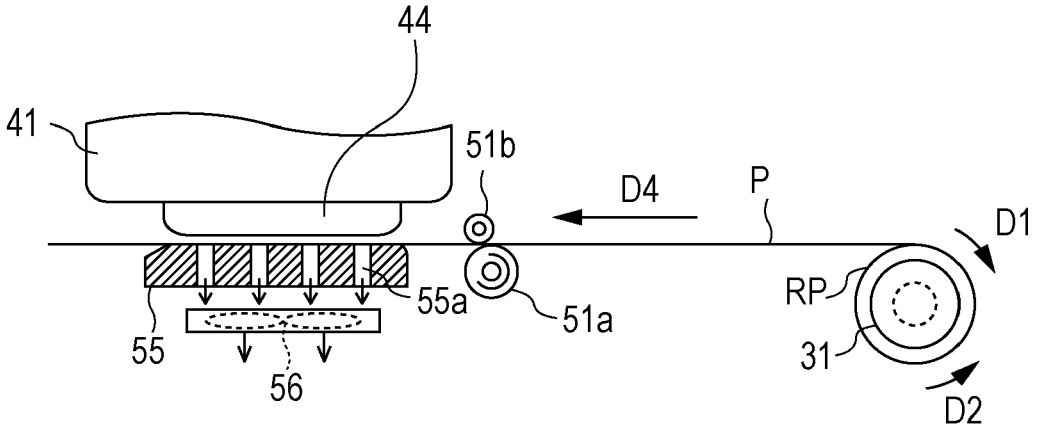
FIG. 2 is a view illustrating a position relationship between a roll body, a driving roller, a driven roller, and a recording head.

As illustrated in FIG. 1 and FIG. 2, the recording apparatus 10 of the embodiment pulls out and feeds a medium P from a roll body RP, and prints an image on the medium P by an ink jet manner. In addition, the roll body RP set in the recording apparatus 10 is prepared by a band shape medium P around a cylindrical core (not illustrated) in a roll shape. Moreover, a material of the medium P is not particularly limited, and for example, may be recording sheet, film, and fabric. A width of the medium P is, for example, 64 inches. A maximum weight of the roll body RP which is capable of being set in the recording apparatus 10 is, for example, 80 kg.

In addition, the recording apparatus 10 is communicatively connected to a computer COM which is an external apparatus. The recording apparatus 10, for example, receives image data for recording the image from the computer COM. Moreover, the recording apparatus 10 is not limited to receiving the image data from the computer COM, and for example, may receive the image data from a recording medium such as a universal serial bus (USB) memory, or the recording apparatus 10 itself may write the image data.

The recording apparatus 10 includes a roll driving mechanism 30, a carriage driving mechanism 40, a medium feeding mechanism 50, a platen 55, and a controller 100.

The roll driving mechanism 30 rotates the roll body RP around which the medium P is wound. The roll driving mechanism 30 includes a pair of rotation holders 31, a roll wheel train 32, a roll motor 33, and a roll rotation detecting unit 34. Moreover, the roll motor 33 is an example of a "rotation driving unit" in Claims.

The rotation holders 31 forming a pair is respectively inserted into both ends of the core of the roll body RP, and holds the roll body RP from both sides. The rotation holders 31 forming a pair is respectively supported to be capable of being rotated by a holder supporting unit (not illustrated). One rotation holder 31 is provided with a roll input gear 32*b* which is engaged with a roll output gear (not illustrated) of the roll wheel train 32. Moreover, the holder supporting unit is an example of a "holding unit" in Claims.

The roll motor 33 applies driving force to the one rotation holder 31. The roll motor 33 is, for example, a direct current (DC) motor. The rotation holder 31 and the roll body RP which is held by the rotation holder 31 are rotated by receiving the driving force transmitted from the roll motor 33 through the roll wheel train 32. More specifically, the roll motor 33 can rotate the roll body RP in a rewinding direction D1 so that the medium P pulled out from the roll body RP is rewound around the roll body RP. In addition, the roll motor 33 can rotate the roll body RP in a feeding rotation direction D2 so that the medium P is fed from the roll body RP. The roll motor 33 rotates the roll body RP in the rewinding direction D1, for example, when positioning a front edge of the medium P. Meanwhile, the roll motor 33 rotates the roll body RP in the feeding rotation direction D2 when performing a feeding operation to be described later.

The roll rotation detecting unit 34 detects a rotation position and a rotation direction of the roll body RP. The roll rotation detecting unit 34 is a rotary encoder including a disk-shaped scale which is installed to an output shaft of the roll motor 33 and a photointerrupter.

The carriage driving mechanism 40 records the image on the medium P which is pulled out from the roll body RP. The carriage driving mechanism 40 includes a carriage 41, a carriage shaft 42, a recording head 44, a carriage motor 45, and a carriage position detecting unit 46. Moreover, the carriage motor 45 is an example of a "moving unit" in Claims, and the recording head 44 is an example of a "liquid discharging unit" in Claims.

The carriage motor 45 drives a belt mechanism (not illustrated) such that the carriage 41 is moved in a moving direction D3 along the carriage shaft 42. In the carriage 41, an ink tank 43 in which each of inks having various colors is stored is installed. In the ink tank 43, the ink is supplied from an ink cartridge (not illustrated) through a tube. In addition, on a bottom surface of the carriage 41, the recording head 44 which is an ink jet head is installed. The recording head 44 discharges the ink which is supplied from the ink tank 43 from a nozzle.

The carriage position detecting unit 46 detects a position of the carriage 41 in the moving direction D3. The carriage position detecting unit 46 is a linear encoder which includes a linear scale installed along the moving direction D3 and the photointerrupter.

The medium feeding mechanism 50 feeds the medium P pulled out from the roll body RP in a feeding direction D4 which is substantially orthogonal to the moving direction D3. The medium feeding mechanism 50 includes a driving roller 51*a*, a driven roller 51*b*, a feeding wheel train 52, a feeding motor 53, and a feeding rotation detecting unit 54. Moreover, the feeding motor 53 is an example of a "feeding driving unit" in Claims.

The driving roller 51*a* and the driven roller 51*b* rotationally feed the medium P which is pinched therebetween. The driving roller 51*a* is provided with a feeding input gear 52*b* which is engaged with a feeding output gear (not illustrated) of the feeding wheel train 52.

The feeding motor 53 applies a driving force to the driving roller 51*a*. The feeding motor 53 is, for example, a DC motor. The driving roller 51*a* is rotated by transmitting the driving force from the feeding motor 53 to the driving roller 51*a* through the feeding wheel train 52, and thus, the driven roller 51*b* is rotated.

The feeding rotation detecting unit 54 detects a rotation position and a rotation direction of the driving roller 51*a*. The feeding rotation detecting unit 54 is a rotary encoder including a disk-shaped scale which is installed to an output shaft of the feeding motor 53 and a photo interrupter.

A platen 55 is installed so as to face the recording head 44. In the platen 55, a plurality of suction holes 55*a* which vertically penetrate the platen 55 is formed. In addition, below the platen 55, a suction fan 56 is installed. When the suction fan 56 is operated, thereby making inside of the suction hole 55*a* have a negative pressure, and then the medium P on the platen 55 is sucked and held thereon. The ink is discharged from the recording head 44 to the medium P which is sucked and held on the platen 55.

The controller 100 controls all of units in the recording apparatus 10. The controller 100 includes a central processing unit (CPU) 101, a read only memory (ROM) 102, a random access memory (RAM) 103, a programmable ROM (PROM) 104, an application specific integrated circuit (ASIC) 105, a motor driver 106, and a bus 107. In addition, the pulse signals from the roll rotation detecting unit 34, the carriage position detecting unit 46, and the feeding rotation detecting unit 54 are input to the controller 100. Moreover, a functional configuration of the controller 100 will be described later.

In the recording apparatus 10 as described above, when a recording job in which the image is recorded on the medium P is performed, a dot forming operation and the feeding operation are repeatedly performed. In other words, the recording apparatus 10 repeatedly and intermittently performs the feeding operation multiple times in one recording job. Here, the dot forming operation is an operation in which dots are formed on the medium P by discharging the ink from the recording head 44 while moving the carriage 41 in the moving direction D3, and this is called a main scan. The feeding operation is an operation in which the medium P is fed in the feeding direction D4, and this is called a sub scan. In the embodiment, one dot forming operation is performed between two feeding operations.

Figure 3:
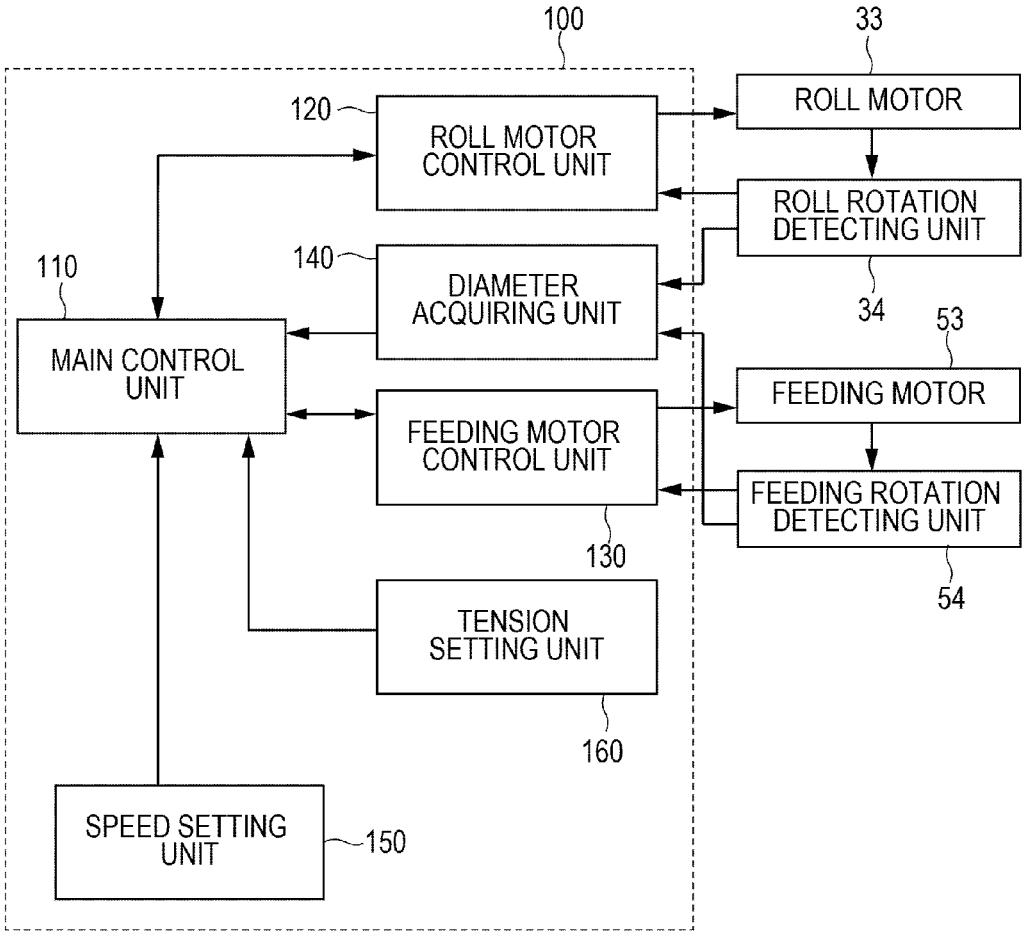
FIG. 3 is a block diagram illustrating a functional configuration example of a controller.

A functional configuration example of the controller 100 will be described with reference to FIG. 3. The controller 100 includes a main controller 110, a roll motor controller 120, a feeding motor controller 130, a diameter acquiring unit 140, a speed setting unit 150, and a tension setting unit 160. Each of these functional units is realized through a cooperation between hardware constituting the controller 100 and software stored in a memory such as the ROM 102.

The main controller 110 gives an instruction to the roll motor controller 120 and the feeding motor controller 130. The main controller 110 can give an instruction to the roll motor controller 120 and the feeding motor controller 130, such that the roll motor 33 and the feeding motor 53 are synchronously driven, or the roll motor 33 and the feeding motor 53 are asynchronously driven. Moreover, the roll motor controller 120 controls an operation of the roll motor 33 such that a constant tension is maintained in the medium P. The tension of the medium P is set by the tension setting unit 160 to be described later. The feeding motor controller 130 controls an operation of the feeding motor 53 by PID control. The feeding motor controller 130 controls the operation of the feeding motor 53 by setting a feeding speed of the medium P by the speed setting unit 150 to be described later.

Figure 4:
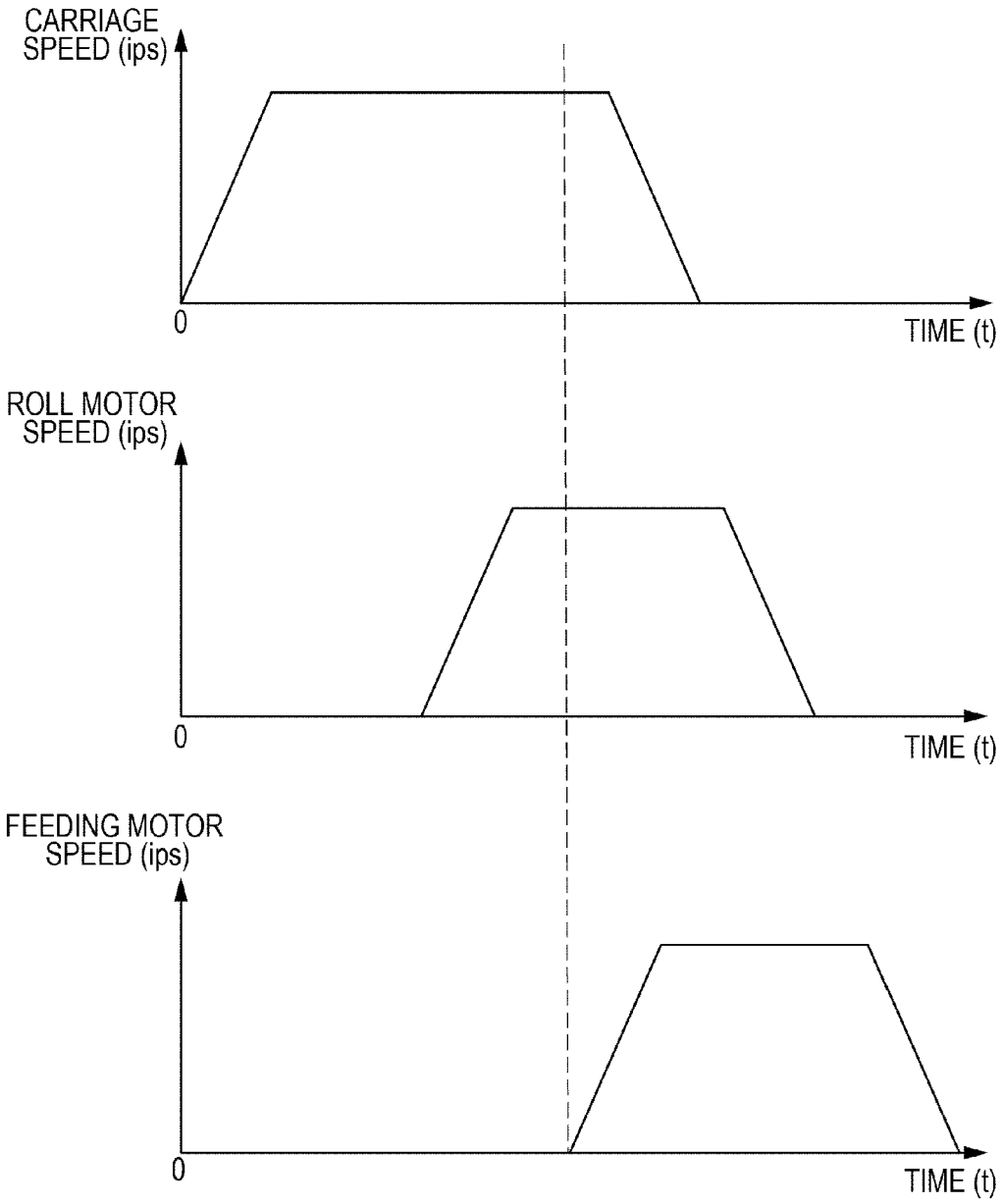
FIG. 4 is a diagram illustrating a timing of starting to operate, a roll motor and a feeding motor with respect to a movement of a carriage, and in the diagram, a case is illustrated in which the roll motor starts to operate before the feeding motor.

As illustrated in FIG. 4, a case will be described in which the main controller 110 gives an instruction to the roll motor controller 120 and the feeding motor controller 130 so that the roll motor 33 and the feeding motor 53 are asynchronously driven.

The carriage motor 45 accelerates and holds a constant speed state, and then decelerates and stops in each dot forming operation. Accordingly, the carriage 41 is moved in the moving direction D3. When the carriage 41 is moved at a constant speed, the recording head 44 performs a discharge operation of the ink.

The main controller 110 counts the number corresponding to a reference position of the carriage 41 and a pulse output from the carriage position detecting unit 46 so as to detect that the carriage 41 has reached the reference position. Here, the reference position is a front position at a predetermined distance from a final discharging position at which the carriage 41 finally discharges the ink in each dot forming operation. Moreover, the main controller 110 is an example of a "reach detecting unit" in Claims. In addition, in a discharging operation by performing each dot forming operation, the final discharging position is a position at which the liquid is finally discharged in order to record the image.

The main controller 110 gives an instruction to the roll motor controller 120 based on a detection of reaching the reference position of the carriage 41 so that the roll motor 33 starts to operate. Accordingly, a delay of a movement of the roll body RP with respect to a movement of the driving roller 51*a* is suppressed by the roll motor 33 starting to operate before the feeding motor 53. Thus, the tension which is excessively applied to the medium P pulled out from the roll body RP can be suppressed.

The main controller 110 gives an instruction to the feeding motor controller 130 so that the feeding motor 53 starts to operate, after a predetermined delay time elapses from the detection to reaching the reference position of the carriage 41. Such a delay time corresponds to a time taken for the carriage 41 to reach to the final discharging position after reaching the reference position. Accordingly, the feeding motor 53 can be controlled to start to operate in synchronization with the timing when the recording head 44 finally discharges the ink in the discharging operation.

Moreover, the reference position and the delay time are changed by a diameter of the roll body RP to be described later, the feeding speed of the medium P, and the tension of the medium P. When the diameter of the roll body RP is large, the delay time becomes long, but when the diameter of the roll body RP is small, the delay time becomes short. In addition, when a speed of the feeding motor 53 is high, the delay time becomes long, but when the speed of the feeding motor 53 is low, the delay time becomes short. Further, when the tension of the medium P is low, the delay time becomes long, but when the tension of the medium P is high, the delay time becomes short. In addition, the reference position becomes a position close to the final discharging position when the delay time is short, but becomes a position far away from the final discharging position when the delay time is long.

The diameter acquiring unit 140 performs a predetermined calculation based on an amount of rotation of the driving roller 51*a* obtained by the feeding rotation detecting unit 54 and an amount of rotation of the roll body RP obtained by the roll rotation detecting unit 34, and obtains a diameter of the roll body RP. The diameter acquiring unit 140 outputs the obtained diameter of the roll body RP to the main controller 110. Accordingly, the delay time can be appropriately changed on the basis of the obtained diameter of the roll body RP.

The speed setting unit 150 sets the feeding speed of the medium P based on an input result from the computer COM, or the like by a user. The speed setting unit 150 outputs the set feeding speed of the medium P to the main controller 110. Accordingly, the delay time can be appropriately changed on the basis of the set feeding speed.

The tension setting unit 160 sets a tension which is applied to the medium P pulled out from the roll body RP based on the input result from the computer COM, or the like by the user. The tension setting unit 160 outputs the set tension to the main controller 110. Accordingly, the delay time can be appropriately changed on the basis of the set tension.

Moreover, the speed setting unit 150 and the tension setting unit 160 calculate the number of pulses based on an image quality of the image input from the computer COM, and may set the feeding speed or the tension of the medium P based on the calculated number of pulses.

Next, a case will be described in which the main controller 110 gives an instruction to the roll motor controller 120 and the feeding motor controller 130 so that the roll motor 33 and the feeding motor 53 are synchronously driven.

Figure 5:
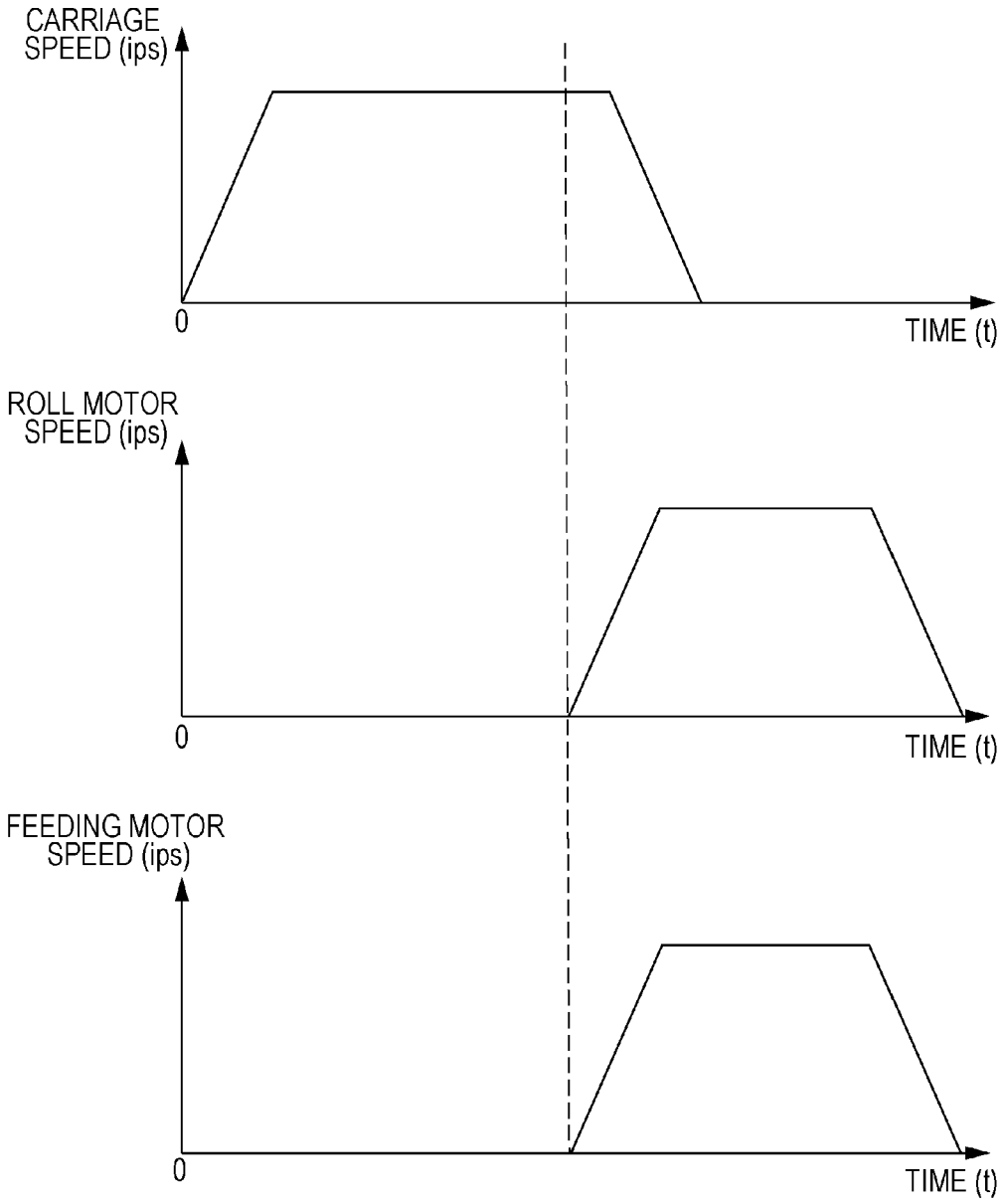
FIG. 5 is a diagram illustrating a timing when starting to operate the roll motor and the feeding motor with respect to the movement of the carriage, and in the diagram, a case is illustrated in which the roll motor and the feeding motor start to operate in synchronization with each other.

As illustrated in FIG. 5, the main controller 110 detects that the carriage 41 reaches the final discharging position by counting the pulses output from the carriage position detecting unit 46. The main controller 110 gives an instruction to the roll motor controller 120 and the feeding motor controller 130 based on a detection of the carriage 41 reaching the final discharging position, so that the roll motor 33 and the feeding motor 53 start to operate in synchronization with each other. Accordingly, the roll motor 33 and feeding motor 53 start to operate in synchronization with a final discharging timing when the recording head 44 finally discharges the ink.

As described above, according to the recording apparatus 10 of the embodiment, since the feeding motor 53 starts to operate in synchronization with the discharging timing when the ink is finally discharged in the discharging operation, the medium P can be started to be fed at the same time as the timing when the ink is finally discharged in the discharging operation. Accordingly, an occurrence of a time interval between the discharging operation of the ink and the feeding operation of the medium P can be suppressed. Accordingly, a throughput of the recording operation can be improved.

Moreover, the embodiment of the invention can be changed to states as follows.

The main controller 110 may detect that the carriage 41 reaches the final discharging position, by counting the number corresponding to the final discharging position of the carriage 41 and the pulses output from the carriage position detecting unit 46.

The main controller 110 may give an instruction to the roll motor controller 120 so that the roll motor 33 start to operate when detecting that the carriage 41 reaches the final discharging position, after a predetermined standby time elapses. In this case, when the standby time is the same as the above described delay time, the roll motor 33 and the feeding motor 53 start to operate in synchronization with each other.

When the roll driving mechanism 30 is not included, a configuration may be adopted in which the medium P is pulled out and fed from the roll body RP by only the medium feeding mechanism 50. In addition, a shape of the medium P is not limited to the roll body RP, and for example, may be a cut-form sheet.

In addition, the main controller 110 does not need to include all of the diameter acquiring unit 140, the speed setting unit 150, and the tension setting unit 160, but may include a part of them.

As an application example of the liquid discharging apparatus of the invention, the recording apparatus 10 discharging the ink is not limited to the above described embodiments, and for example, an apparatus which discharges various liquids such as a liquid crystal material, an organic electro-luminescence (EL) element material, and a metal wiring material to various work such as a glass substrate may be used.

The entire disclosure of Japanese Patent Application No. 2014-125090, filed Jun. 18, 2014 is expressly incorporated by reference herein.

What is claimed is:

1. A liquid discharging apparatus comprising:

a feeding unit that feeds a medium;

a feeding driving unit that drives the feeding unit;

a liquid discharging unit that performs a discharging operation of discharging liquid to the medium;

a carriage that moves the liquid discharging unit in a scan direction orthogonal to a feeding direction of the medium during the discharging operation;

a reach detecting unit that detects that the liquid discharging unit reaches a position that is a set distance from a final discharging position where the liquid discharging unit finally discharges the liquid in the discharging operation;

a holding unit that holds a roll body around which the medium is wound;

a rotation driving unit that rotates the roll body through the holding unit so that the medium is pulled out from the roll body; and a controller that controls the feeding driving unit, on the basis of a reach detection by the reach detecting unit, to start to operate in synchronization with a timing when the liquid discharging unit finally discharges the liquid in the discharging operation, which is performed while the carriage is moved at a constant speed, wherein the controller, on the basis of the reach detection by the reach detecting unit, controls the rotation driving unit to start to operate.

2. The liquid discharging apparatus according to claim 1, wherein the controller controls the rotation driving unit so that the rotation driving unit starts to operate before starting to operate the feeding driving unit.

3. The liquid discharging apparatus according to claim 1, wherein the controller controls the rotation driving unit to start to operate in synchronization with an operation starting of the feeding driving unit.

4. The liquid discharging apparatus according to claim 2, wherein the controller controls the feeding driving unit to start to operate after a delay time elapses from the reach detection.

5. The liquid discharging apparatus according to claim 4, wherein the controller includes a diameter acquiring unit which acquires a diameter of the roll body, and wherein the controller changes the delay time based on the diameter of the roll body acquired by the diameter acquiring unit.

6. The liquid discharging apparatus according to claim 4, wherein the controller includes a speed setting unit which sets a feeding speed of the medium, and wherein the controller changes the delay time based on the feeding speed set by the speed setting unit.

7. The liquid discharging apparatus according to claim 4, wherein the controller includes a tension setting unit which sets a tension applied to the medium between the roll body and the feeding unit, and wherein the controller changes the delay time based on the tension set by the tension setting unit.

* * * * *